US006990686B2

(12) United States Patent
Palmer

(10) Patent No.: US 6,990,686 B2
(45) Date of Patent: Jan. 31, 2006

(54) PROTECTIVE GARMENT FOR CAREGIVERS OF INFANTS AND SMALL CHILDREN

(76) Inventor: Scott William Palmer, 3660 Masters Dr., Colorado Springs, CO (US) 80907

( * ) Notice: Subject to any disclaimer, the term of this patent is extended or adjusted under 35 U.S.C. 154(b) by 0 days.

(21) Appl. No.: 10/214,452

(22) Filed: Aug. 7, 2002

(65) Prior Publication Data

US 2004/0025220 A1 Feb. 12, 2004

(51) Int. Cl.
*A41D 3/00* (2006.01)

(52) U.S. Cl. ..... 2/69; 2/46; 2/92

(58) Field of Classification Search ..... 2/69, 2/79, 114, 456, 457, 2.5, 46, 49.1, 49.4, 50, 2/51, 59, 70, 71, 82, 85, 86, 87, 92, 93, 97, 2/108, 115, 121, 122, 227, 243.1, 272, 461, 2/901, 904, DIG. 5
See application file for complete search history.

(56) References Cited

U.S. PATENT DOCUMENTS 1,322,602 A * 11/1919 Nogar ..... 2/82
1,784,158 A * 12/1930 Place ..... 2/87
2,417,888 A 3/1947 Schuster
2,556,621 A * 6/1951 Higgins ..... 2/87
2,563,420 A 8/1951 Roe
2,580,388 A 1/1952 Allen
2,617,105 A 11/1952 Backman
2,635,243 A 4/1953 Eskey
3,018,486 A * 1/1962 Bukspan ..... 2/87
3,259,913 A * 7/1966 Tames ..... 2/114
3,868,728 A * 3/1975 Krzewinski ..... 2/114
3,871,027 A 3/1975 Orr
3,916,447 A * 11/1975 Thompson ..... 2/46
4,050,099 A 9/1977 David
4,285,067 A 8/1981 David
4,322,858 A * 4/1982 Douglas ..... 2/463
4,408,356 A * 10/1983 Abrams ..... 2/87
4,504,977 A * 3/1985 King et al. ..... 2/51
4,546,492 A * 10/1985 Dickenson ..... 2/46
4,555,811 A * 12/1985 Shimalla ..... 2/51
4,639,946 A 2/1987 Koenig
4,663,782 A 5/1987 Knox et al.
4,710,980 A 12/1987 Brison et al.
4,713,842 A 12/1987 Patterson
4,736,467 A * 4/1988 Schwarze et al. ..... 2/114
4,783,858 A * 11/1988 Chevalier ..... 2/90
4,982,448 A * 1/1991 Kogut ..... 2/51
4,991,232 A * 2/1991 Taylor ..... 2/51
4,995,116 A 2/1991 Beauchamp et al.
5,008,960 A 4/1991 Hemming
5,014,360 A * 5/1991 Smith et al. ..... 2/115
5,029,344 A * 7/1991 Shannon et al. ..... 2/69
5,062,160 A * 11/1991 Dillon, Jr. ..... 2/114

(Continued)

*Primary Examiner*—Alissa L. Hoey
(74) *Attorney, Agent, or Firm*—Holme Roberts & Owen LLP

(57) ABSTRACT

An article of clothing has a front and back, each of which has a layered structure, including a protective layer for impeding the flow of liquid through the article of clothing, and an absorbing layer external to the protective layer, for absorbing the liquid and slowing its flow downward on the exterior surface of the article of clothing, with the force of gravity, a lining for facilitating the donning and removal of the article of clothing, and sleeves and a collar that is closeable, to protect the wearer's neck area and upper arms from deposits of liquid on the wearer's upper shoulder and chest areas.

5 Claims, 4 Drawing Sheets

U.S. PATENT DOCUMENTS 5,075,901 A * 12/1991 Vollrath ..... 2/115
5,077,838 A * 1/1992 Senser ..... 2/69
5,101,515 A 4/1992 Holt et al.
5,155,867 A * 10/1992 Norvell ..... 2/113
5,157,789 A * 10/1992 Klass ..... 2/114
5,218,720 A * 6/1993 Tolton ..... 2/97
5,432,952 A 7/1995 Tate
5,444,871 A * 8/1995 Lopez ..... 2/114
5,454,119 A * 10/1995 Thomm ..... 2/114
5,461,724 A * 10/1995 Wiedner et al. ..... 2/457
5,526,532 A * 6/1996 Willard ..... 2/69
5,526,534 A * 6/1996 Lazar ..... 2/97
5,640,715 A * 6/1997 Adams ..... 2/46
5,673,433 A * 10/1997 Rothrum ..... 2/46
5,694,646 A * 12/1997 Roberts ..... 2/114
5,806,097 A * 9/1998 Grilliot et al. ..... 2/81
5,960,471 A 10/1999 Burton
5,996,122 A * 12/1999 Aldridge et al. ..... 2/81
6,128,783 A * 10/2000 Blauer et al. ..... 2/90
6,216,281 B1 * 4/2001 Fricke ..... 2/272
6,235,659 B1 * 5/2001 McAmish et al. ..... 442/79
6,327,712 B1 * 12/2001 Armstrong et al. ..... 2/104
6,385,774 B1 * 5/2002 Rodgers ..... 2/50
6,490,734 B2 * 12/2002 Blauer et al. ..... 2/87

* cited by examiner

PROTECTIVE GARMENT FOR CAREGIVERS OF INFANTS AND SMALL CHILDREN

BACKGROUND

1. Field

The present invention relates to protective clothing and, in particular, to a garment useful for protecting the clothing and body of a caregiver for an infant and a small child.

2. State of the Art

Persons caring for infants and small children may often be required to carry or hold the child. Liquid or semi-liquid materials on the child's face, hands, chest or clothing may be smeared or deposited on the caregiver's clothing or body. An infant who is bottle-feeding is held against the caregiver's shoulder or chest area for feeding, and drops of milk, juice or formula may drip out of the infant's mouth or the bottle and fall onto the caregiver. Also, after an infant has been fed from a bottle, a common practice is to burp the infant, causing it to expel air it has ingested while feeding. When the infant is burped, it may also expel a mixture of liquid and solid material. If the infant is positioned with its head at the shoulder of the caregiver, the mixture that is expelled from the baby on burping may flow with the force of gravity down the holder's chest or back. Liquids and liquid-containing materials can be transferred to the upper body or arms of a person holding a child in various other ways, including leakage from diapers, drooling, and vomiting. Persons charged with looking after animal babies, in zoos or veterinary hospitals, may have a similar experience with liquid and semi-liquid materials being deposited on their bodies and clothing. As a result, the clothing of the person holding the baby is soiled or stained.

To reduce the risk that clothing will be soiled or stained, persons holding babies use towels, aprons, blankets, folded cloth diapers and the like on the shoulder to protect their clothing. These coverings are not liquid resistant so that liquids will soak-through or transfer through the covering. In addition, these commonly used items are not of sufficient size to fully protect the caregiver.

Various other articles have been suggested for persons dealing with babies. For example, U.S. Pat. No. 2,617,105 describes a rectangular piece of flexible material that is draped over the caregiver's shoulder, but which leaves portions of the upper body uncovered and can be easily pushed aside. U.S. Pat. No. 2,563,420 describes a bib or combined bib and apron to be worn on the caregiver's shoulder or around the neck. U.S. Pat. No. 3,871,027 describes a disposable absorptive pad, to be placed on the wearer's shoulder and held in place by adhesive means. These articles are not suitable for use with heavier or bulky clothing such as jackets or suits, are not of sufficient dimension, do not take into account the gravitational flow of liquid materials, and are often awkward to put on and remove. This is especially troublesome for working fathers and mothers, and other caregivers, who wear professional clothing, and are asked to help with feeding an infant immediately before or after work while still wearing their professional clothing.

SUMMARY

An article of clothing inhibits the transfer of liquid from liquid-containing material in contact with the exterior of the article of clothing through the article of clothing to the interior of the article of clothing. The article of clothing includes a back sized to cover at least a portion of the wearer's upper body, the back having a length extending between about the top of wearer's shoulder area and at least about the wearer's waist. The back includes a back protective layer formed of a material inhibiting the transfer of liquid from the liquid-containing material, and the back protective layer extends between about the top of wearer's shoulder area and about at least the bottom of the lower shoulder area of the wearer.

The back also includes a back absorbing layer formed of a liquid-absorbing material to absorb liquid from the liquid-containing material. The back-absorbing layer is positioned external to the back protective layer and is sized to extend between about the top of wearer's shoulder area and about at least the lower shoulder area of the wearer.

The article of clothing further includes a front extending from the back toward the abdomen of the wearer and sized to cover at least a portion of the wearer's upper body, the front having a length extending between said back and about the upper abdomen of the wearer. The front includes a front protective layer formed of a material inhibiting the transfer of liquid from the liquid-containing material, the front protective layer extending from the back protective layer to about the upper abdomen area of said wearer, and a front absorbing layer formed of a liquid-absorbing material to absorb liquid from the liquid-containing material, the front absorbing layer being positioned external to the front protective layer and sized to extend from the back absorbing layer toward about the lower rib cage of the wearer.

In a preferred embodiment of the article of clothing, the back includes a back lining extending from about said wearer's shoulder area to the wearer's lower rib cage, the back lining being formed of a material having a coefficient of friction facilitating slidable movement of the article of clothing relative to wearer while donning and doffing the article of clothing. In a more preferred embodiment, the front of the article of clothing includes a front lining extending from the shoulder area of the wearer to about the lower rib cage of the wearer, the front lining being formed of a material having a coefficient of friction facilitating slidable movement of the article of clothing relative to the wearer while donning and doffing the article of clothing. In alternate configurations of this embodiment, the back lining is selected from a group consisting of silk, poly-silk, rayon, nylon, polyester, rayon blended with at least one other material, and polyester blended with at least one other material.

In another version, the article of clothing includes a sleeve attached to the front and the back proximate the shoulder of the wearer and extending away from the shoulder a sleeve distance extending at least over the elbow. In an alternate version, the sleeve distance of the article of clothing extends away from the shoulder to at least the wearer's wrist. In a further version, the article of clothing has two sleeves.

In further configurations, the front of the article of clothing has a width that extends about the width of the chest of the wearer, and the back has a width that extends about the width of the back of the wearer. In another embodiment, the front has a width that extends across the front of the wearer, wherein the front has a left edge and a right edge, and wherein the back has a width that extends across the back of the wearer and is joined to said front at said left edge and at said right edge to surround the body of the wearer. In one version, this embodiment can include a securing means for removably securing the article of clothing about the wearer. In another embodiment, the article of clothing has an upper edge and lower edge, with the upper edge positioned proximate the wearer's neck, and the securing means includes a split extending between the upper edge and the lower edge to create a first edge and a second edge, and includes also an attachment means for detachably attaching said first edge and said second edge. In a version of this embodiment, the attachment means is selected from a group consisting of at least one button and a corresponding button hole, the button hole sized to receive the button for attaching and detaching the first edge and the second edge; a hook and pile connector; a zipper; and at least two straps for attaching and detaching said first edge and said second edge.

In a highly preferred arrangement, a raised surface is provided above the back of said article of clothing to hinder a flow of liquid-containing material from a deposit of such material on the wearer's upper back, descending down the back of the article of clothing when the wearer's back is oriented in a generally upright orientation, said raised surface being positioned external to the back protective layer and the liquid absorbing layer, and extending substantially across the width of the back. In one version of this arrangement, the raised surface is a band, formed of liquid absorbing material and having a height of about 1/16 inch. In another preferred arrangement, the article of clothing includes a collar joined to the upper edge of the article, for releasably closing around the neck of the wearer to protect at least a portion of the wearer's neck area from deposits of liquid-containing material in the wearer's upper shoulder and chest area.

In further versions of the article of clothing, the length of the front and the length of the back both extend from the top of the wearer's shoulder area to at least about the wearer's upper thigh. In another version, the length of the front and the length of the back of the article of clothing extend to at least about the wearer's lower waist. In other aspects, the front protective layer and the front absorbing layer of the front of the article of clothing cover the entire area of the front, and the back protective layer and the back absorbing layer cover the entire area of the back.

In another version, one or both sleeves also has a layered structure, including a sleeve protective layer formed of material for inhibiting the transfer of liquid from the liquid-containing material, a sleeve absorbing layer to absorb liquid from said liquid-containing material deposited on said sleeve and being positioned external to the sleeve protective layer. In a preferred version, one or both sleeves also has a sleeve lining, formed of a material having a coefficient of friction to facilitate slidable movement of the sleeve relative to the wearer while donning and doffing the article of clothing, the sleeve lining being positioned internal to the sleeve protective layer.

In yet a further embodiment, the article of clothing is a jacket, including a front and a back and two sleeves, the length of the front and the length of the back extending between about the top of the wearer's shoulder area and at least about the wearer's upper thigh. The front and the back each include a protective layer, inhibiting the transfer of liquid-containing material, covered by an absorbing layer, for absorbing liquid from liquid-containing material, and a lining, internal to the protective layer, the lining formed of material having a coefficient of friction facilitating slidable movement of the article of clothing relative to the wearer when the wearer dons and doffs the article of clothing. The article of clothing also includes sleeves, for covering the wearer's right and left arms, joined to the front and the back, and extending away from the wearer's shoulder area a sleeve distance to about the wrist of the wearer. The sleeves also include a sleeve protective layer, a sleeve absorbing layer external to the sleeve protective layer, and a sleeve lining internal to the sleeve protective layer. The jacket includes a closeable collar for protecting the wearer's neck from deposits of liquid-containing material on the wearer's upper shoulder and chest area. In a further embodiment, the article of clothing has at least one pocket.

In a further and preferred arrangement, the jacket includes a raised surface joined to the back of the article of clothing, for hindering the movement of liquid deposited on the wearer's upper shoulder and flowing down the back of said article of clothing in response to the force of gravity when the wearer's back is oriented in a generally upright orientation.

DETAILED DESCRIPTION

Figure 1B:
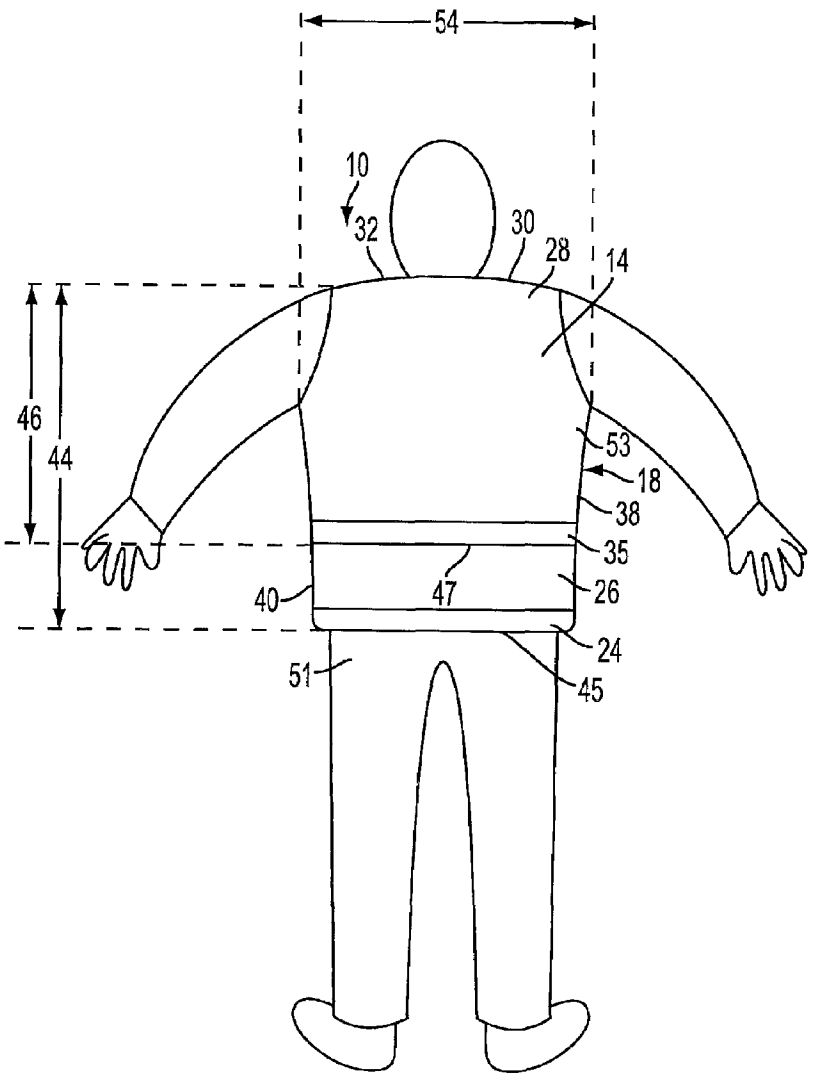
FIG. 1B is a back planar view of the article of clothing of FIG. 1A.
Figure 1A:
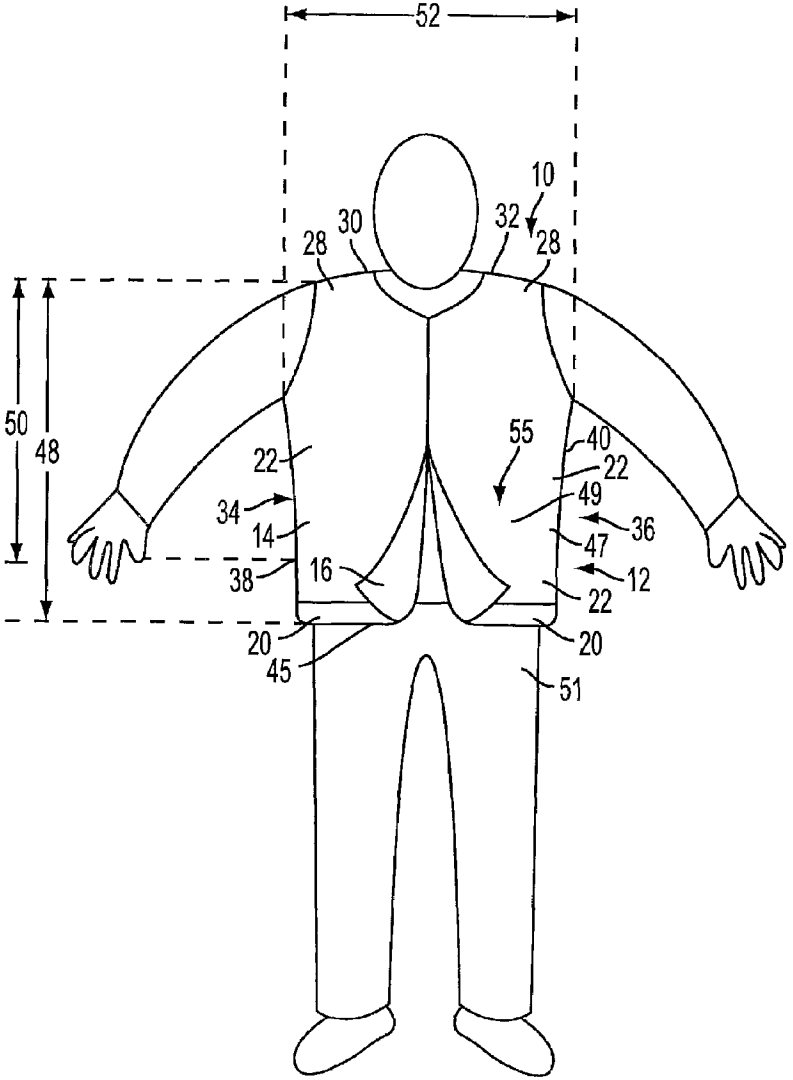
FIG. 1A is a front planar view of an embodiment of the article of clothing of the present invention.

FIG. 1A depicts the front 12 and FIG. 1B depicts the back 18 of an article of clothing 10 for inhibiting the transfer of liquid from liquid-containing material in contact with or deposited on the exterior 14 of the article of clothing 10 through the article of clothing 10 to the interior 16 of the article of clothing 10. In FIG. 1A, the exterior 14 of the front 12 includes a front protective layer 20 and a front absorbing layer 22. Similarly, the back 18 includes a back protective layer 24 and a back absorbing layer 26.

Figure 1C:
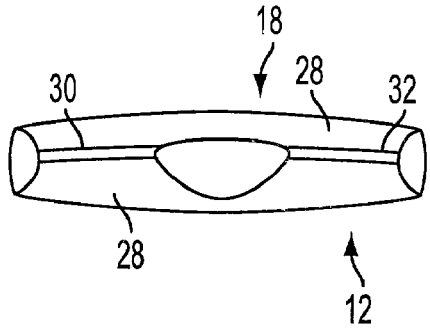
FIG. 1C is a top view of the article of clothing of FIGS. 1A and 1B.

As better seen in FIG. 1C, the back 18 is joined to the front 12 proximate and preferably at the top 28 of the wearer's shoulder. The back 18 and front 12 also may be joined by unitarily forming them from the same material. However, it is presently preferred to effect a joinder of the front 12 and back 18 by any suitable joining method including sewing, stapling, UV welding (depending on materials selected), gluing, snaps, buttons or any other method that effectively joins the front 12 and back 18 together. As here shown, a right shoulder seam 30 and a left shoulder seam 32 are formed by sewing.

Figure 1D:
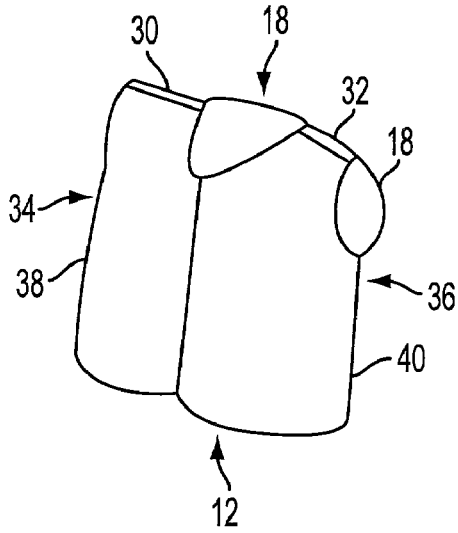
FIG. 1D is a frontal perspective view of the article of clothing of FIGS. 1A and 1B.
Figure 1E:
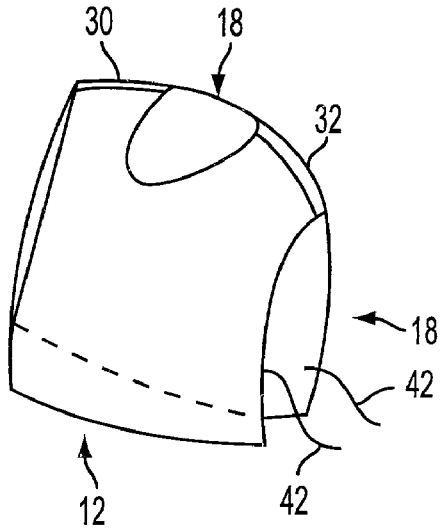
FIG. 1E is a frontal perspective view of an alternate embodiment of an article of clothing of the present invention.

As shown in FIG. 1D, the front 12 and back 18 may also be joined at a right side 34 and a left side 36 by any suitable joining method including sewing, stapling or any other method that effectively joins the front 12 and back 18 together. As shown in FIG. 1D, the front 12 and back 18 are joined by sewing which forms a right side seam 38 and a left side seam 40. In an alternate arrangement, depicted in FIG. 1E, the front 12 and back 18 are joined by sewing at the right shoulder seam 30 and left shoulder seam 32 while joinder at the side is optional and may be effected by tie strings 42 sized to be operable by the wearer to tie any suitable knot and also sized to be of sufficient length to accommodate individuals of different waist and chest size including those of much larger girth.

Referring again to FIGS. 1A and 1B, the back 18 is sized to cover at least a portion of the wearer's upper body, and has a length 44 extending between about the top 28 of the wearer's shoulder area and at least about the wearer's lower waist 45. In another embodiment, the back 18 is sized differently, with a length 46 extending to about the wearer's upper waist 47. In a further embodiment, the back 18 extends from about the top 28 of the wearer's shoulder area to about the wearer's upper thigh 51. The front 12 extends from the back 18 toward the abdomen 49 of the wearer and is sized to cover at least a portion of the wearer's upper body, the front 12 having a length 48 extending between the back 18 and at least about the wearer's lower waist 45. In another embodiment, the front 12 is sized differently, with a length 50 extending to about the wearer's upper waist 47. In a further embodiment, the front 12 extends from the back 18 to at least about the wearer's upper thigh 51. As depicted on FIG. 1A, the front 12 has a width 52, extending from the right side 34 to the left side 36 of the front 12, covering the wearer's chest and abdomen area 49, and as depicted in FIG. 1B the back 18 has a width 54, covering the wearer's back. In other embodiments, each of the front 12 and back 18 may be sized to cover a smaller portion of the wearer's upper body, and may be of narrower design, with a smaller width.

In the embodiment of FIGS. 1A and 1B, the front 12 and back 18 are joined at side seams 38 and 40; and the article of clothing 10 surrounds the girth of the wearer. In a preferred embodiment, the front 12 and back 18 of the article of clothing 10 are sized to provide the wearer with a loose fit, enabling the wearer to wear bulky clothing under the article of clothing 10, including professional clothing such as a suit jacket. In a highly preferred embodiment, the front 12 and the back 18 are sized to loosely fit so that a person would be able to pull on the article and secure at least about ½ inch of open space between the interior 16 of the article of clothing 10 and the surface of the wearer's chest and abdomen 49.

Referring again to FIGS. 1A and 1B, the front absorbing layer 22 is external to the front protective layer 20. The back absorbing layer 26 is also external to the back protective layer 24. The back protective layer 24 is formed of a material inhibiting the transfer of liquid from liquid-containing material. The back protective layer 24 extends from about the top 28 of the wearer's shoulder area to the wearer's lower waist 45, although in other embodiments the back protective layer 24 may extend a smaller distance to at least about the bottom of the lower shoulder area 53 of the wearer. The back absorbing layer 26 is formed of a liquid-absorbing material to absorb liquid from liquid-containing material that may be deposited on the article of clothing 10. The back-absorbing layer 26 is sized to extend between about the top of the wearer's shoulder area and the wearer's lower waist 45, although in other embodiments it may extend to about at least the lower shoulder area 53 of the wearer.

The front protective layer 20 is also formed of a material inhibiting the transfer of liquid from liquid-containing material. Referring to FIG. 1A, the front protective layer 20 extends from the back protective layer 24 at the top 28 of the wearer's shoulder area to about the wearer's lower waist 45, although in other embodiments it may extend to at least about the upper abdomen area 55 of the wearer. The front absorbing layer 22 is formed of a liquid-absorbing material to absorb liquid from liquid-containing material. The front absorbing layer 22 is sized to extend from the back absorbing layer 26 to about the wearer's lower waist 45 although in other embodiments it may be sized to extend to at least about the upper abdomen area 55 of the wearer.

In a preferred arrangement, the front protective layer 20 and front absorbing layer 22 are substantially coextensive, with the front protective layer 20 underlying every portion of front absorbing layer 22, and so hindering the transfer of liquid on the surface of the front absorbing layer 22 through the article of clothing 10 to the wearer's body or to other clothing worn by the wearer. In a preferred arrangement, as depicted in FIG. 1A, the outer edge of the front protective layer 20 extends beyond the outer edge of the front absorbing layer 22. It should be noted that, in other embodiments the front 12 and back 18 of the article of clothing 10, including the front protective layer 20 and the front absorbing layer 22, and the back protective layer 24 and back absorbing layer 26, extend further to cover and protect the upper leg and lap area of the wearer, with a length extending from the wearer's shoulder area to about the wearer's upper thigh 51.

Any of a variety of materials resistant to the flow-through of liquid therethrough can be used to form the front protective layer 20 and back protective layer 24. While there is no intention herein to limit the material used, in a preferred embodiment, the material used to form the front protective layer 20 and back protective layer 24 is a thin sheet of closed cell foam rubber, having a thickness of at least ⅛ inch. However, any of a variety of plastic or other synthetic materials resistant to the flow or transfer of moisture therethrough can be substituted. In a highly preferred arrangement, the material used is breathable, and resists a flow of liquid in one direction through the material but permits the flow-through and escape of vapor in the opposite direction through the material.

Similarly, any of a variety of materials that absorb liquid or moisture can be used to form the front absorbing layer 22 and the back absorbing layer 26. In a preferred embodiment, the material used to form the front absorbing layer 22 and the back absorbing layer 26 is a cotton or cotton-synthetic blend, such as terrycloth or similar materials used for toweling, although there is no intention herein to limit the material used to these materials. Other natural or synthetic materials can be substituted, which have a characteristic of absorbing liquid or moisture. In a highly preferred arrangement, a loosely woven, knitted or textured cotton material, with an uneven surface, which absorbs fluid and physically hinders the flow of liquid along the surface of the materials, forms the front absorbing layer 22 and back absorbing layer 26.

Figure 2:
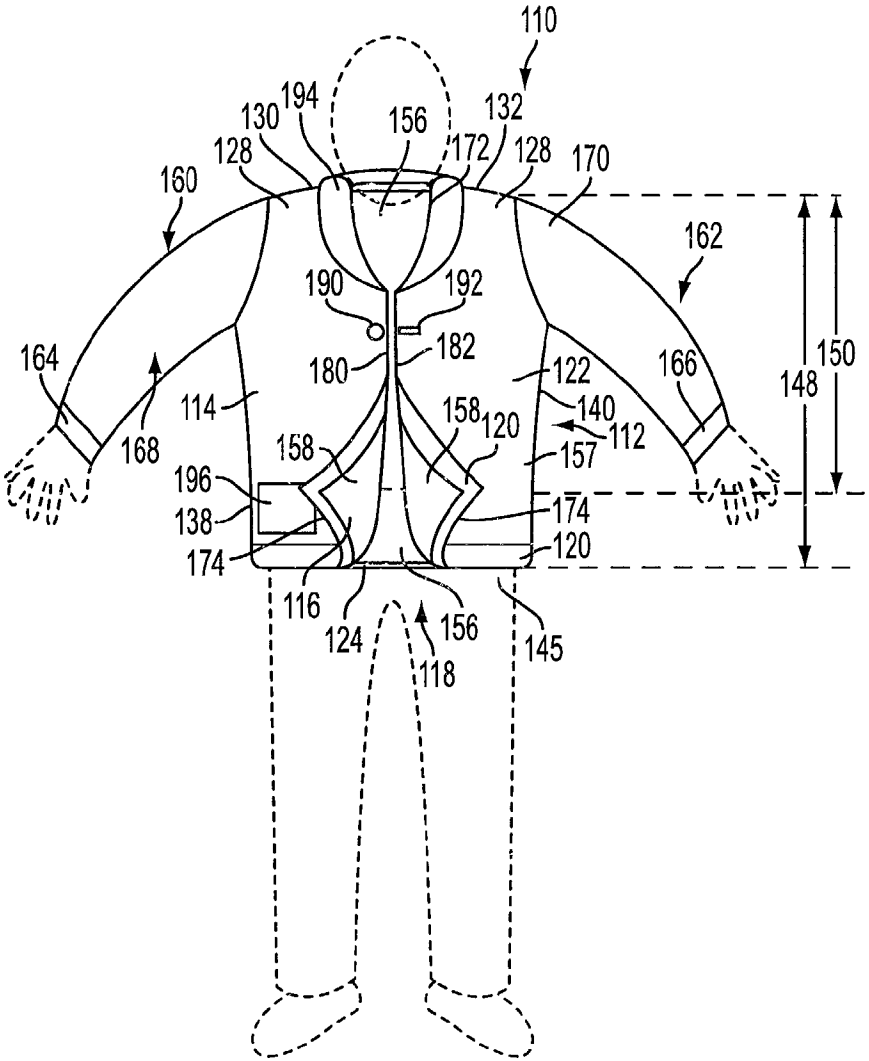
FIG. 2 is a front planar view of an alternate embodiment of an article of clothing of the present invention.

FIG. 2 depicts another embodiment of the article of clothing 110, which includes a front 112 and back 118, the front 112 having a front protective layer 120 and a front absorbing layer 122 external to the front protective layer 120, and the back 118 having a back protective layer 124 and a back absorbing layer (not shown) external to the back protective layer 124. The back 118 of the article of clothing 110 includes a back lining 156, positioned internal to the back protective layer 124. The back lining 156 extends from about the wearer's upper shoulder area 128 to about the wearer's lower waist 145, having a length 148 and in other embodiments may have a shorter length 150 extending to at least about the wearer's lower rib cage 157. In a further embodiment, the front 112 of the article of clothing 110 includes also a front lining 158, positioned internal to the front protective layer 120. The front lining 158 has a length 148, extending from about the wearer's upper shoulder area 128 to about the wearer's lower waist 145, although in other embodiments the front lining 158 may have a shorter length 150 extending to at least about the wearer's lower rib cage. The front lining 158 and back lining 156 are each formed of a material having a coefficient of friction facilitating slidable movement of the article of clothing 110 relative to the wearer while the wearer is donning and doffing the article of clothing 110. In a preferred arrangement, the material from which the front lining 158 and back lining 156 are formed is selected from a group consisting of silk, poly-silk, rayon, nylon, polyester, rayon blended with at least one other material, and polyester blended with at least one other material. There is no intention to limit the material used in the back and front linings, 156, 158, to the aforementioned list of materials so long as the coefficient of friction is such that the article of clothing is slidable and easy to don and doff.

In the embodiment depicted in FIG. 2, the article of clothing 110 includes a right sleeve 160 covering the wearer's right arm. The right sleeve 160 is attached to the front 112 and the back 118 proximate the right shoulder of the wearer. Attachment may be effected by sewing, glueing or other means as hereinbefore mentioned. The right sleeve 160 extends from the wearer's right shoulder to at least the wearer's right wrist, although in other embodiments it may extend a shorter distance, at least over the right elbow of the wearer. In a further embodiment, the article of clothing 110 includes a left sleeve 162 covering the wearer's left arm. As depicted in FIG. 2, the left sleeve 162 is attached to the front 112 and the back 118 proximate the left shoulder of the wearer by any suitable means such as sewing. The left sleeve 162 extends away from the wearer's left shoulder to at least the wearer's left wrist, although in other embodiments, a shorter left sleeve 162, extending at least over the wearer's elbow, is used. In yet other embodiments, the article of clothing 110 is sleeveless, or has short sleeves extending from the wearer's shoulder a distance between the wearer's shoulder and elbow.

Referring to FIG. 2, in a preferred embodiment, the front 112 and back 118 of the article of clothing 110 are joined at side seams 138, 140, and shoulder seams 130, 132, and with sleeves 160, 162, form a jacket arrangement.

In a preferred embodiment and referring to FIG. 2, the right sleeve 160 and left sleeve 162 are each formed with a layered structure, including a right sleeve protective layer 164, and left sleeve protective layer 166, formed of material for inhibiting the flow of liquid from liquid-containing material deposited on the sleeve, and a right sleeve absorbing layer 168 and a left sleeve absorbing layer 170, formed of material for absorbing liquid from liquid-containing material deposited on the sleeves 160, 162. The right and left sleeve absorbing layers 168, 170 are both positioned external to the right and left sleeve protective layers, 164, 166, respectively.

In a more preferred embodiment, each of the right and left sleeves also includes a lining, formed of a material having a coefficient of friction to facilitate slidable movement of the sleeve relative to the wearer while donning and doffing the article of clothing. The right sleeve lining is positioned internal to the right sleeve protective layer 164 and the left sleeve lining is positioned internal to the left sleeve protective layer 166. The right and left sleeve linings extend from the top of the respective right and left sleeves 160, 162 at the wearer's shoulders, to at least about the wearer's elbow area on each arm. In another version, the sleeve linings extend farther to about the wearer's wrist area of the respective right or left arm.

Figure 3:
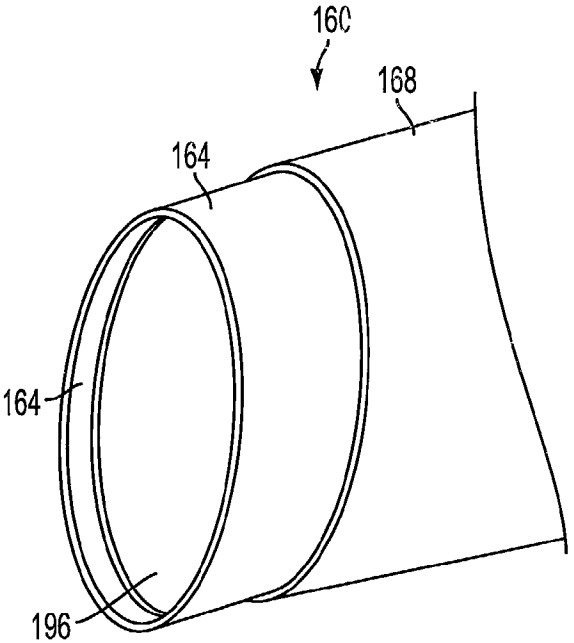
FIG. 3 is an enlarged view of a cross-section of a portion of a sleeve of the embodiment shown in FIG. 2.

FIG. 3 provides an enlarged cross-sectional view of a portion of the right sleeve 160 of FIG. 2, showing the right sleeve protective layer 164, the right sleeve absorbing layer 168, and the right sleeve lining 196. In the present embodiment, the left sleeve lining has a similar structure and configuration to the right sleeve lining and it is therefore not felt necessary to depict its arrangement.

In a further embodiment, depicted in FIG. 2, the article of clothing 110 includes securing means for removably securing the article of clothing about the wearer. As depicted in FIG. 2, the front 112 of the article of clothing 110 has an upper edge 172 and a lower edge 174, the upper edge 172 positioned proximate the wearer's neck. In this arrangement, the front 112 is divided into two pieces, forming a first edge 180 and a second edge 182, and the securing means is comprised of the first edge 180 and the second edge 182 and an attachment means for detachably attaching the first edge 180 and the second edge 182. In a preferred arrangement, the attachment means is a button 190 on the first edge 180 and a corresponding buttonhole 192 on the second edge 182, for releasably securing the first edge 180 to the second edge 182. More than one button and buttonhole can be used, and other attachment means, including hook and pile connector systems and zippers, can be substituted for the button and buttonhole arrangement. In a highly preferred embodiment, the button 190 is at least one inch in diameter, and the buttonhole 192 is sized with the length of the buttonhole 192 at least ¾ inch larger than the diameter of the button 190, facilitating ease of fastening the button within the buttonhole.

Referring again to FIG. 2, in yet another embodiment, the article of clothing 110 includes a collar 194 joined to the upper edge 172 and the back 118 for releasably closing around the neck of the wearer to protect at least a portion of the wearer's neck area from deposits of liquid-containing material in the wearer's upper shoulder and neck area. In a preferred arrangement, the collar 194 is formed of a material that inhibits the transfer of liquid from liquid-containing material, and includes a flap that lies flat on the article of clothing when not in use but that can be lifted up and folded around the wearer's neck when in use.

In another embodiment, depicted in FIG. 2, the article of clothing 110 includes a pocket 196, attached to the front absorbing layer 122. In a preferred embodiment, the pocket 196 is large, having a width of at least about 4 inches and a height of at least about 4 inches, to accommodate items such as feeding bottles, and is located on the lower portion of the article of clothing 110. The pocket 196 is formed of a single piece of material, a first portion of which is attached to the front absorbing layer 122 by any suitable means such as sewing, leaving a second portion unattached, such second portion and first portion forming an enclosure open on one end for holding or storing articles or items. Other embodiments include more than one pocket.

In a further embodiment, and referring to FIG. 1B, the article of clothing 10 includes a raised surface 35 on the back absorbing layer 26, that physically impedes the flow of liquid and liquid-containing materials downward on the back when the wearer is in an upright orientation. In a preferred arrangement, the raised surface 35 is a band of material of at least ⅛" inch in height above the surface of the back absorbing layer 26, that extends substantially across the back 18 of the article of clothing. Other arrangements of the raised surface 35 include the use of multiple bands of material extending across the width of the back.

Figure 4:
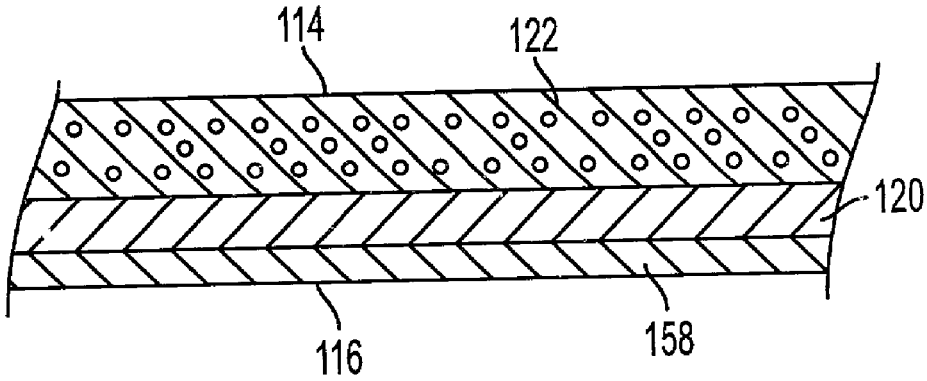
FIG. 4 is an enlarged view of a cross-section of a portion of an article of clothing depicting the front lining, front protective layer and front absorbing layer suitable for use in the embodiment of FIG. 2.

FIG. 4 is an enlarged cross-sectional view of a portion of the front 112 of the article of clothing 110 depicted in FIG. 2, showing the exterior 114 of the article of clothing 110, the front absorbing layer 122, the front protective layer 120, the front lining 158, and the interior 116 of the article of clothing 110. When liquid-containing material is deposited on the exterior 114, liquid from the liquid-containing material soaks into the front absorbing layer 122, but is substantially prevented from transferring through the front 112 to the interior 116. In a preferred embodiment, the front absorbing layer 122, front protective layer 120, and front lining 158 are in loose contact and are attached only at seam lines of the article of clothing, such as the side seams 138, 140, and shoulder seams 130, 132, depicted in FIG. 2.

Figure 5:
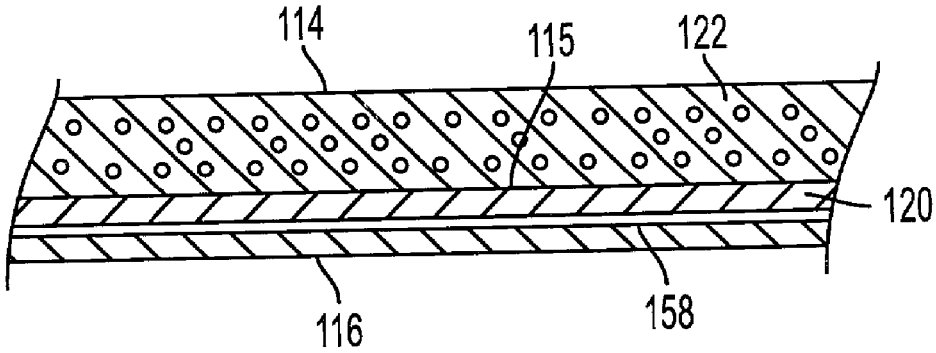
FIG. 5 is an enlarged view of a cross-section of an alternate embodiment of a portion of an article of clothing depicting the front lining, front protective layer and front absorbing layer.

FIG. 5 depicts an enlarged cross-sectional view of another layered arrangement of a portion of the front 112 of the article of clothing 110 depicted in FIG. 2, in which the front protective layer 120 is a thin layer that is adheringly attached to the interior surface 115 of the front absorbing layer 122, and the front lining 158 is positioned internal to the front protective layer 120, but is only attached to the front protective layer 120 at one or more seam lines of the article of clothing 10. Any of a variety of layered arrangements, with varying thicknesses, composition, and methods for attaching the layers, may be substituted for the two arrangements specifically described herein, including lamination, and layered fabric construction, and the description herein is not intended to limit the approaches that may be taken. The layered structures depicted in FIGS. 4 and 5 also are used with the back 118 and sleeves 160, 162 of the embodiment of FIG. 2.

It will be understood by those familiar with the art that the article of clothing depicted herein in its various embodiments will be sized for various body shapes and sizes according to standards typically followed in the garment industry. The description of the illustrated embodiments is not intended to limit the scope of the claims, which follow.

I claim:

1. An article of clothing for inhibiting the transfer of liquid from liquid-containing material contacting the exterior of said article of clothing through said article of clothing to the interior of said article of clothing, said article of clothing comprising:

a back sized to cover at least a portion of the wearer's upper body, said back having a length extending between about the top of wearer's shoulder area and at least about the wearer's waist, said back including a back protective layer formed of a material inhibiting the transfer of liquid from said liquid-containing material, said back protective layer extending between about the top of wearer's shoulder area and about at least at the bottom of the lower shoulder area of the wearer, and a back absorbing layer formed of a liquid-absorbing material to absorb liquid from said liquid-containing material, said back-absorbing layer being positioned external to said back protective layer and sized to extend between about the top of wearer's shoulder area and about at least the lower shoulder area of the wearer;

a front extending from said back toward the abdomen of said wearer and sized to cover at least a portion of the wearer's upper body, said front having a length extending between said back and about the upper abdomen of said wearer, said front including a front protective layer formed of a material inhibiting the transfer of liquid from said liquid-containing material, said front protective layer extending from said back protective layer to about the upper abdomen area of said wearer, and a front absorbing layer formed of a liquid-absorbing material to absorb liquid from said liquid-containing material, said front absorbing layer being positioned external to said front protective layer and sized to extend from said back absorbing layer toward about the lower rib cage of the wearer; and a raised surface formed of liquid absorbing material joined to the back of said article of clothing, for hindering a flow of liquid-containing material down the back of said article of clothing resulting when the wearer's back is oriented in a generally upright orientation and said liquid-containing material is deposited in the area of the wearer's upper back, said raised surface being positioned external to said back protective layer and said back liquid absorbing layer, and extending substantially across the width of said back.

2. The article of clothing of claim 1, wherein said raised surface is a band, having a height of about 1/16 inch.

3. The article of clothing of claim 1, wherein said raised surface includes a plurality of bands of material extending substantially across the width of the back.

4. A jacket for inhibiting the transfer of liquid from liquid-containing material in contact with the exterior of said jacket through said jacket to the interior of said jacket, said jacket comprising:

a back having a length extending between about the top of the wearer's shoulder area and at least about the wearer's upper thigh, and a width extending about the width of the wearer's back, said back including a back protective layer formed of a material inhibiting the transfer of liquid from said liquid containing material, said back protective layer having an area substantially the same as said back, a back absorbing layer formed of a liquid-absorbing material, said back absorbing layer being positioned external to said back protective layer, and sized to cover substantially the entire area of said back protective layer, and a back lining, formed of a material having a coefficient of friction selected to facilitate slidable movement of the jacket relative to the wearer while donning and doffing said jacket, said back lining positioned internal to said back protective layer and sized to extend from about said wearer's shoulder area to at least about the wearer's lower rib cage area, a front having a length extending from said back to at least about the wearer's upper thigh, and having a width sized to cover about the width of the wearer's chest, said front including a front protective layer formed of a material inhibiting the transfer of liquid from said liquid-containing material, said front protective layer having an area substantially the same as said back, a front absorbing layer formed of a liquid-absorbing material for absorbing liquid from said liquid-containing material, said front-absorbing layer positioned external to said front protective layer and having an area substantially the same as said back, and a front lining being formed of a material having a coefficient of friction selected for slidable moving of said jacket relative to said wearer while donning and doffing said article of clothing, said front lining positioned internal to said front protective layer and sized to extend from about said wearer's shoulder area to at least about the wearer's lower rib cage area;

sleeves attached selectively to said front and back, proximate to the wearer's shoulder, to cover the wearer's right and left arms, each sleeve extending away from the wearer's shoulder a preselected distance, said sleeves including a sleeve protective layer, formed of a material inhibiting the transfer liquid from said liquid containing material, said sleeve protective layer having an area substantially the same as said sleeve, a sleeve absorbing layer, formed of a liquid-absorbing material, said sleeve absorbing layer being positioned external to said sleeve protective layer, and sized to cover substantially the entire area of said sleeve protective area, and a sleeve lining, formed of a material having a coefficient of friction selected to facilitate slidable movement of the sleeves of the jacket relative to the wearer while donning and doffing the jacket, said sleeve lining positioned internal to said sleeve protective layer and sized to extend from said wearer's shoulder area to about said wearer's wrist; and a collar, joined to said front and said back, and including closeable flaps for closing around the wearer's neck area; and a band of liquid absorbing material joined to the back of said jacket, for providing a raised surface above the back of said jacket to hinder a flow of liquid-containing material down the back of said jacket resulting when the wearer's back is oriented in a generally upright orientation and liquid-containing material is deposited on the wearer's upper back area, said band of material being positioned external to said back protective layer and said back absorbing layer, and extending substantially across the width of said back.

5. The jacket of claim 4, wherein, instead of one band of material, there is a plurality of bands of material joined to the back of said jacket.

* * * * *